US006837249B2

(12) United States Patent
Smith

(10) Patent No.: US 6,837,249 B2
(45) Date of Patent: Jan. 4, 2005

(54) SUPPLEMENTAL HAIR ATTACHMENT METHOD AND APPARATUS

(75) Inventor: Darla J. Smith, Maple Grove, MN (US)

(73) Assignee: International Hairgoods, Inc., Chanhassen, MN (US)

( * ) Notice: Subject to any disclaimer, the term of this patent is extended or adjusted under 35 U.S.C. 154(b) by 0 days.

(21) Appl. No.: 10/177,584

(22) Filed: Jun. 19, 2002

(65) Prior Publication Data

US 2003/0234027 A1 Dec. 25, 2003

(51) Int. Cl.[7] ..... A41G 3/00
(52) U.S. Cl. ..... 132/201
(58) Field of Search ..... 132/201, 53, 54, 132/55, 56, 200, 251, 275, 265

(56) References Cited

U.S. PATENT DOCUMENTS 3,530,862 A * 9/1970 Hudson ..... 132/53
4,600,029 A * 7/1986 Ueberschaar ..... 132/53
5,121,761 A * 6/1992 Meister ..... 132/201
5,357,986 A * 10/1994 Hargrett ..... 132/201
5,551,452 A * 9/1996 Barlow ..... 132/54
5,868,147 A * 2/1999 Davidson ..... 132/251
5,899,209 A * 5/1999 McDonald et al. ..... 132/53
6,109,274 A * 8/2000 Ingersoll ..... 132/201

OTHER PUBLICATIONS

*New Alternatives*, Modern Salon, Nov. 2001.

* cited by examiner

*Primary Examiner*—Cary E. O'Connor
*Assistant Examiner*—Robyn Kieu Doan
(74) *Attorney, Agent, or Firm*—Nawrocki, Rooney & Sivertson, P.A.

(57) ABSTRACT

The present invention provides an article and method for supplementing scalp hair. The article includes a body having at least one aperture formed therethrough and a plurality of fibers. Each fiber is threaded through an aperture and around the body. Scalp hair is threaded through a body aperture and body position adjacent the scalp. Crimping of the body secures the article to the scalp hair.

1 Claim, 3 Drawing Sheets

SUPPLEMENTAL HAIR ATTACHMENT METHOD AND APPARATUS

BACKGROUND OF THE INVENTION

The present invention relates generally to the field of hair supplements. More particularly, the present invention provides methods and apparatus for attachment of human or synthetic supplemental hair fibers to growing (natural) scalp hair.

The application of supplemental hair has become desirable for several purposes. For example, a person with thin hair (or hair loss in a particular area) may desire supplemental hair to replace the lost hair, or to provide more volume. In some circumstances, it is desirable or fashionable to add length to the hair. In these instances, longer supplemental hair or supplemental hair extensions may be added to the existing hair to provide the desired length.

Several techniques have been developed to volumize and/or extend hair. In one technique, a plurality of hair fibers are glued directly to the growing scalp hair. This method is often messy and may leave visible globs of glue in the hair. The glue also raises issues of chemical sensitivity.

A second method utilizes a sleeve that is tightened onto overlapping scalp hair and supplemental hair to hold the supplemental hair in place. Although this method avoids the mess of the glue method, the sleeve remains exposed which either detracts from the overall look of the hair or requires that the stylist use other scalp hair to hide the sleeves.

A third method employs a weft having a plurality of fibers attached along the length of a cable. The cable is then attached to the scalp hair, typically by weaving the scalp hair around the cable. This weaving of the hair is time consuming to both install the weft, and to remove it.

SUMMARY OF THE INVENTION

The present invention provides a supplemental hair attachment article for attaching a plurality of supplemental hair fibers to a plurality of scalp hairs. For the purpose of this specification and claims, the term "scalp hair" means natural, growing hair.

The article includes a body having an aperture formed therethrough to form a bead and a plurality of supplemental hair fibers. Each fiber is threaded through the aperture and wrapped around the body of the bead. In a preferred embodiment, the supplemental hair fibers are knotted onto the body. For example, a supplemental hair fiber may be tied to the body by looping each fiber through the aperture, and around the body, and tying the fiber to itself. Such a tying process is known in the industry and is commonly called ventilating.

An article in accordance with the present invention may also be constructed with an elongated cable having at least one bead secured thereto and a plurality of supplemental hair fibers ventilated to the cable. The bead has an aperture formed therethrough. In this embodiment, the bead(s) may be secured to the cable by tie members threaded through the bead aperture. The cable may alternatively be threaded through the bead aperture. Preferably, the article has multiple beads spaced approximately one inch from each other along the length of the cable. A plurality of supplemental hair fibers are ventilated or otherwise attached to the cable along its length and between the spaced beads.

The bead employed in the practice of the present invention may be fabricated from any suitable material and preferably one that does not normally interact with the body, jewelry materials, for example, have the desired body compatibility. In the practice of the present invention, the bead will be crimped to engage scalp hair and supplemental hair threaded through the aperture. The supplemental hair fibers may be made of natural hair, polyester, nylon, and other suitable materials. The attachment of the fibers to the bead may be accomplished by knotting or gluing. Additionally, silicone may be utilized to enhance the grip of the crimped bead and to cushion the scalp hair and supplemental hair fibers within the bead body.

The present invention also includes a method of fabricating a supplemental hair attachment article for attachment of a plurality of supplemental hair fibers to a plurality of scalp hairs. The steps of the method include providing a bead having an aperture therethrough and a plurality of supplemental hair fibers. The fibers are threaded through the aperture and around the bead body. The fibers may be secured to the bead in any known manner, preferably by ventilating.

The present invention also includes a method for applying a supplemental hair attachment article to a plurality of scalp hairs. The steps of this method include providing an article formed of a bead having an aperture with a plurality of supplemental hair fibers threaded through the aperture and wrapped around the bead body. The scalp hairs are threaded through the aperture of the bead and the article is slid along said scalp hair and affixed, as by crimping the bead, to the scalp hair adjacent the scalp.

DESCRIPTION OF THE PREFERRED EMBODIMENTS

Figure 1:
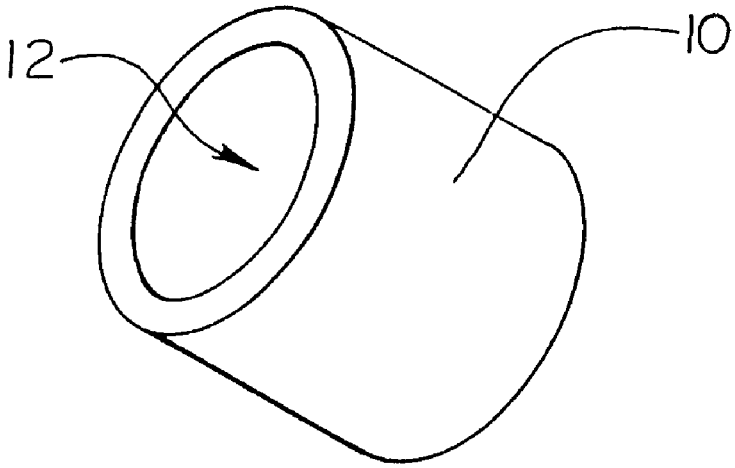
FIG. 1 illustrates a bead employed in the practice of the present invention.

The present invention provides a supplemental hair attachment system whereby a plurality of supplemental hair fibers are secured to a plurality of scalp hairs. A bead, having an aperture, carries a plurality of supplemental hair fibers. The bead may be of any suitable shape. One such example is shown in FIG. 1, wherein the shape of the bead 10 is cylindrical and the aperture 12 is formed through the longitudinal axis of the body 10. Suitable beads for the practice of the present invention are common in the jewelry industry and are known as crimp beads made of sterling silver. In a preferred embodiment, the bead 10 is 1 mm. long and has an aperture 12 diameter of 0.051 inches. The aperture 12 must be large enough to accommodate both the fibers to be added as well as the scalp hair to which the bead 12 is attached.

Figure 2:
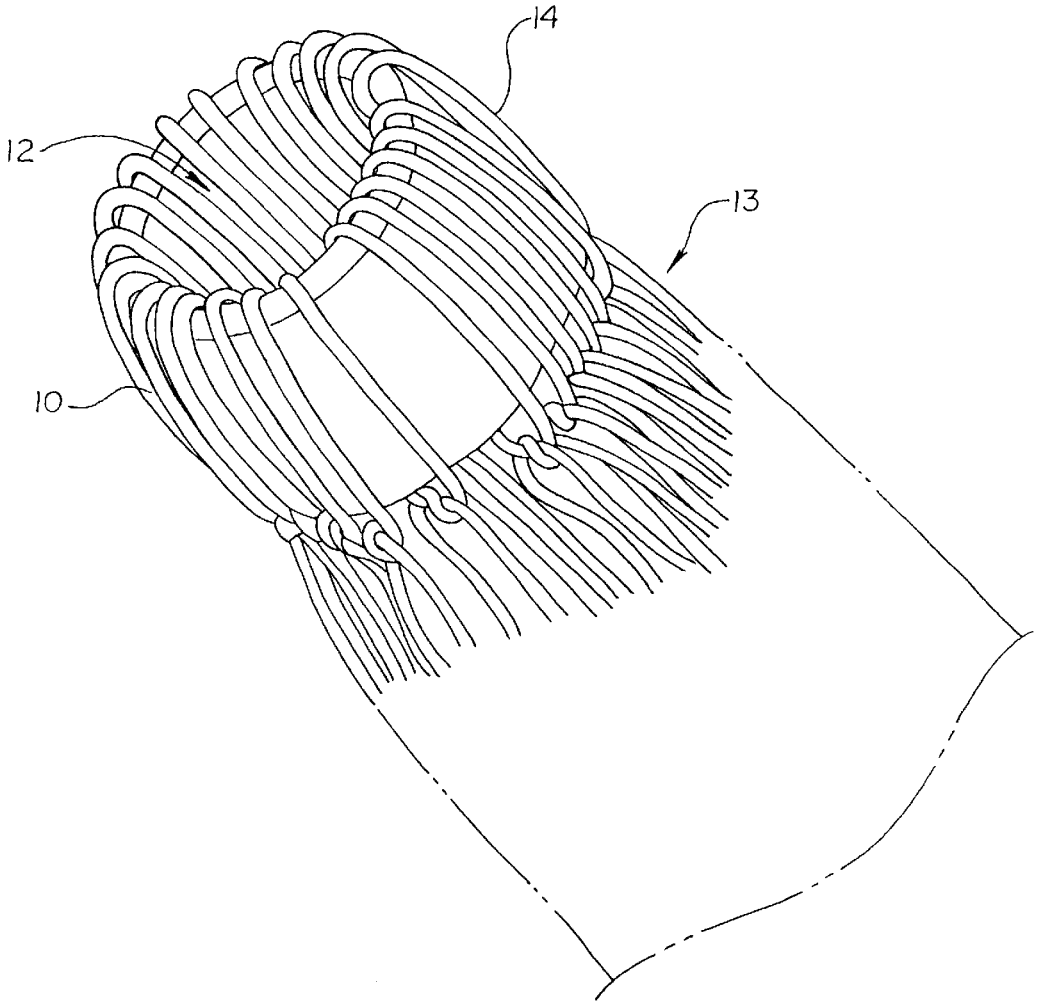
FIG. 2 shows an article in accordance with the present invention including the bead of FIG. 1 and a plurality of fibers carried thereby.

In a preferred embodiment of the present invention, and as shown is FIG. 2, supplemental hair fibers 14 are threaded through the aperture 12 and around the bead body 10. Preferably, sufficient supplemental hair fibers 14 are attached to the bead 10 to obscure the surface of the bead 10 from view, particularly when in place in the hair. With the bead 10 described, 75–100 fibers will accomplish the desired result.

Preferably, the article is constructed and arranged such that the supplemental hair fibers 14 are knotted/ventilated onto the bead body. For example, the fibers may be tied to the bead at one end by looping each fiber through the aperture and over the head and tying the fiber to itself (as shown generally at 13 in FIG. 2), or to one or more of the other fibers attached to the bead body. The use of knotting eliminates the need for gluing or the use of any other securing materials and their attendant problems. However, it is forseeable that glue, silicone, and other materials may be utilized in some embodiments of the invention. For example, the end of the bead opposite the knots may be dipped in silicone. The silicone provides a gripping surface and cushion for both the supplemental fibers and the scalp hair to be threaded through the aperture, as described more fully below.

Figure 3:
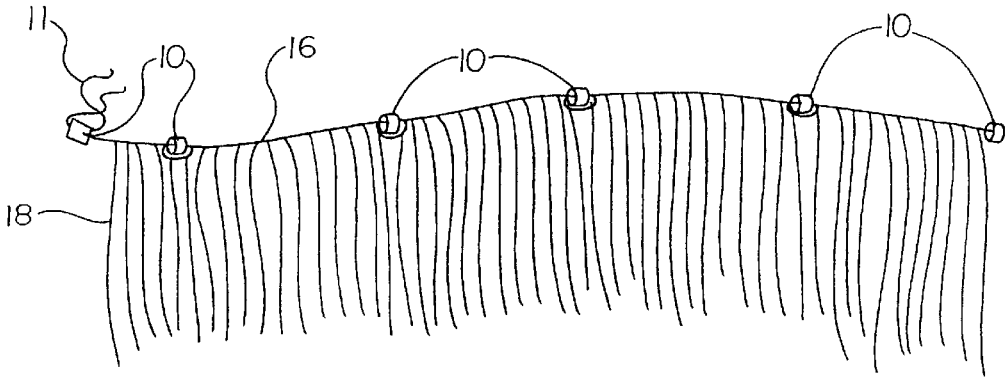
FIG. 3 shows another embodiment in accordance with the present invention wherein a plurality of fibers are attached to a cable, the cable having a plurality of beads spaced along its length.

A further embodiment is shown in FIG. 3, including a cable 16 having at least one bead 10 attached thereto and a plurality of supplemental hair fibers 18 ventilated to the cable 16. As with the embodiment of FIG. 2, the body 10 has an aperture 12 formed therethrough. As shown in FIG. 3, the cable may be threaded through the aperture 12 of the bead body 10. Alternatively, the bead 10 may be secured to the cable by ties 11 threaded through the bead aperture 12 and either tied to, or woven into, the cable 16. In this embodiment, it is preferred that the bead apertures 12 be generally parallel to the direction of elongation of the cable 16. Silicone may be employed in the manner and for the reasons stated above in reference to FIG. 2. The beads 10 of FIG. 3 may be identical to those described above with reference to FIGS. 1 and 2.

As shown in FIG. 3 , the article may have two or more beads 10 attached, spaced apart from each other, along a cable 16. The preferred spacing is approximately one inch. As shown, the fibers 18 are attached to the cable 16, between the spaced bodies 10. To apply this embodiment to the scalp hair, a plurality (8–10) of scalp hairs are threaded through the beads 10 attached to the cable 16 as described more fully below. The bead bodies are then crimped to engage the scalp hair, also described more fully below.

In addition to the articles described above, the present invention also includes a method for fabricating a supplemental hair attachment article. The steps of the method include providing a bead body having at least one aperture therethrough and a plurality of supplemental hair fibers. The method provides that the fibers are threaded through one of the apertures and around the bead body.

The present invention also includes a method for applying a supplemental hair attachment article to a plurality of scalp hairs. The steps of this method include providing an article having a bead body with at least one aperture therethrough. The article also has a plurality of supplemental hair fibers attached to the bead body by being threaded through at least one of the apertures and around the bead body. Scalp hair is threaded through an aperture of the bead body. Threading may be facilitated by sewing needle "threader" passing through the bead aperture and a crochet needle which "hooks" eight (8) to ten (10) strands of scalp hair and pulls it through the needle threader. When the needle threader is withdrawn from the bead aperture, the scalp hair is drawn through the bead aperture. With the scalp hair threaded through the bead aperture, the bead is slid along said scalp hair to a location adjacent the scalp, and affixed to the scalp hair, as by crimping the bead. Crimping may be accomplished in any desired manner. It has been found that a needle-nose pliers is useful for this purpose and, more particularly a bent-nose pliers.

Although the present invention has been described with reference to preferred embodiments, workers skilled in the art will recognize that changes may be made in form and detail and combinations of one or more features of the embodiments may be made without departing from the spirit and scope of the invention. For example, the supplemental hair fibers in any of the described embodiments may be selected to match or highlight the natural scalp hair. Alternatively, bright colors of any hue may be employed. Further, since many possible embodiments may be made of the present invention without departing from the scope thereof, it is to be understood that all matter herein set forth or shown in the accompanying drawings is to be interpreted in the illustrative and not a limiting sense.

What is claimed is:

1. A method for applying a supplemental hair attachment article to a plurality of scalp hairs, the steps of the method comprising;

providing a bead having a body with an aperture therethrough and having a plurality of supplemental hair fibers attached through said aperture around said body;

threading a plurality of scalp hairs through said aperture;

sliding said bead along said scalp hair to a location adjacent the scalp; and crimping said bead to said scalp hair.

* * * * *